United States Patent [19]

Crow

[11] Patent Number: 4,982,896

[45] Date of Patent: Jan. 8, 1991

[54] SPRAY WAND

[76] Inventor: Lee Crow, 8218 Cordelia Cir., Citrus Heights, Calif. 95621

[21] Appl. No.: 259,185

[22] Filed: Oct. 17, 1988

[51] Int. Cl.[5] ..... B05B 1/04

[52] U.S. Cl. ..... 239/11; 239/532; 239/594

[58] Field of Search ..... 239/532, 592–595, 239/597–599, 601, 568, 525, 526

[56] References Cited

U.S. PATENT DOCUMENTS

| | | | |
|---|---|---|---|
| D. 179,807 | 3/1957 | Malsbary | D62/2 |
| D. 287,993 | 1/1987 | Crow | D23/17 |
| 153,672 | 8/1874 | Fowler . | |
| 282,959 | 3/1886 | Powell | D23/17 |
| 721,766 | 3/1903 | Williamson | 239/215 |
| 873,301 | 12/1907 | Cummings | 239/592 |
| 1,022,345 | 4/1912 | Walhaus | 239/592 X |
| 1,644,226 | 10/1927 | Bedard | 239/597 X |
| 2,116,863 | 5/1937 | Dinley | 299/154 |
| 2,130,173 | 9/1937 | Barnes | 299/154 |
| 2,130,629 | 9/1938 | Clayter | 239/568 X |
| 2,981,484 | 4/1961 | Hirsch | 239/530 |
| 2,985,386 | 5/1961 | Stumen | 239/597 |
| 3,191,623 | 6/1965 | Bowles | 137/613 |
| 3,416,736 | 12/1968 | Marik | 239/597 X |
| 3,447,756 | 6/1969 | Lawrence | 239/568 X |
| 3,700,174 | 10/1972 | Beck | 239/532 X |
| 3,834,629 | 9/1974 | Hellman | 239/597 |
| 3,858,812 | 1/1975 | Williams et al. | 239/601 X |
| 3,977,570 | 8/1976 | Smrt | 222/174 |
| 4,141,507 | 2/1979 | Rump | 239/597 X |
| 4,238,074 | 12/1980 | Coons | 239/199 |
| 4,267,782 | 5/1981 | Talbott | 111/7.1 |
| 4,323,196 | 4/1982 | Logan et al. | 239/532 |
| 4,326,553 | 2/1983 | Hall | 239/592 X |

FOREIGN PATENT DOCUMENTS

| | | | |
|---|---|---|---|
| 24103 | 2/1981 | European Pat. Off. | 239/532 |
| 644050 | 11/1927 | France . | |
| 1212596 | 2/1986 | U.S.S.R. | 239/597 |
| 594751 | 7/1946 | United Kingdom . | |
| 741008 | 11/1955 | United Kingdom | 239/592 |

*Primary Examiner*—Andres Kashnikow
*Assistant Examiner*—Kevin P. Weldon
*Attorney, Agent, or Firm*—Bernhard Kreten

[57] ABSTRACT

A fluid wand including a pistol grip, a nozzle and a tubular body communicating there between. The nozzle includes a hemispherical end wall adjacent a slit like opening configured as a rectangular box-like passageway and the piston grip maintains constant pressure on either side of an on/off valve. The emerging flow emanating therefrom is configured initially as an elongate ribbon which thereafter, due to enhanced cohesive forces engendered in a hemispherical end wall portion of the nozzle, causes the ribbon to reform as a substantially solid cylindrical shaft of fluid.

8 Claims, 1 Drawing Sheet

30"

SPRAY WAND

FIELD OF THE INVENTION

The following invention relates generally to spray wands of the type which emit water from an outlet end of the spray wand's nozzle.

BACKGROUND OF THE INVENTION

It is frequently desirable to use a fluid such as water for cleaning, rinsing or debris removal Because of the physical properties of a fluid such as water, fine mists may be used to flush debris in areas having limited access to other types of implements, and for these applications many known existing spray heads have been found to be effective.

However, when a particular application requires the presence of a coherent, focused stream of fluid, prior art structures are less than satisfactory. For example, when one wants to remove debris which is relatively heavy or adhering to a surface which is to be washed, it is important to have a coherent stream of water to provide maximum force at the area of interest.

The engineering problem is twofold: first, the nozzle geometry must be such that the stream of water exiting therefrom achieves an appropriate velocity; second, the emerging stream should have the appropriate shape to most efficiently focus on the desired target. Although water pressure is a foundational prerequisite, the proper fluid distribution characteristics vary as a function of nozzle geometry. The following patents reflect the state of the art of which applicant is aware insofar as they appear germane to the instant process. It is stipulated that at best, these patents share mere coincidental structural similarity with applicant's invention and have been included in response to applicant's acknowledged duty to disclose known prior art.

The patent to Dinley teaches the use of a known spray nozzle structure in which a generally cylindrically shaped tube is flattened at one end to form a substantially rectangular slit and then is provided with bevelled side walls to form a fluid stream which is substantially fan shaped. This patent provides neither a rectangular box-like passage way serving as an outlet nor a hemispherical end wall in the nozzle communicating with the passage way. Consequently, the fluid stream is different.

The patents to Malsbury, Talbert, Koonze, and Hirsch each teach the use of a spray device having a valve operated lever which pivots to provide through passage of fluid. None of these patents reflect the valve structure forming applicant's invention. The remaining citations show the state of the art further and diverge even more from that which is claimed as the instant invention.

SUMMARY OF THE INVENTION

By way of contrast, the instant invention is directed to an instrumentality which exits the nozzle not only at a relatively high velocity, but in the geometrical configuration of an elongate ribbon of water wherein the molecules of water have a special cohesive affinity. Upstream of the nozzle, the fluid chamber is of circular cross section, and at the area where the elongate rectangular box-like slit communicates with the chamber, a hemispherical wall contacts the fluid providing turbulence before the fluid exits through the slit. It is the turbulence which alters the characteristic of the fluid giving it a greater affinity for cohesion. The emerging flow manifests itself in the water exiting the nozzle in the form of elongate ribbon, but approximately 30 inches from the nozzle opening, the water ribbon reforms on its own and is re-configured as a solid cylindrical shaft of water.

In addition, a pistol type valve grip is provided which is configured both for ergonomic efficiency and structured to render negligible any decrease of water pressure at the valve site.

The combined effect of nozzle geometry and valve structure provide a fluid wand which exhibits at least two distinct fluid patterns simultaneously: a first ribbon shaped fluid stream which can contact a surface providing a "chisel" type effect and a second coherent solid cylinder of water providing a concentrated force of fluid at a given spot. By imparting to the fluid an affinity for cohesion in the hemispherical portion of the nozzle chamber and directing the fluid through an elongate slit, the fluid past the nozzle resists the natural propensity of water to disperse into a plurality of droplets and rather forces self collimation with the effect that water configured as a solid shaft will retain its penetrating properties over a longer length of the water path.

OBJECTS OF THE INVENTION

It is a primary object to the instant invention to provide a novel and useful fluid wand.

A further object of the present invention is to provide a device as characterized above which is extremely durable in construction, lightweight and safe to use, and benefits from economies of scale associated with mass production techniques.

A further object to the present invention is to provide a device as characterized above which imparts molecular cohesion in a fluid stream so that the liquid will exit the nozzle as a substantially elongate planar ribbon and then reform itself into a substantially solid cylindrical shaft of fluid.

The further object of the present invention is to provide a device as characterized as above which, because of the cohesive affinity, allows the stream of fluid to travel greater distances than other nozzle geometry configurations would provide at the same water pressure.

A further object of the present invention is to provide a device as characterized as above where there is minimal loss of pressure at a hand operated valve, the valve housing being biomechanically configured for ease of use.

Viewed from one vantage point, it is an object of the present invention to provide a device for emitting a fluid stream which essentially exits the device as a substantially flat ribbon and transforms itself down stream into a solid fluid cylindrical shaft which includes a nozzle having an inlet, an outlet and a chamber interposed there between providing fluid communication. The outlet formed is a substantially rectangular box shaped passageway, the portion of the chamber adjacent to the outlet having a substantially hemispherical end wall whereby fluid passing there beyond has imparted thereto a cohesive force which causes the fluid to assume a downstream solid shaft-like shape after exiting the nozzle as a ribbon.

A further object of the invention, when viewed from a second vantage point, includes the provision of a fluid dispensing device having a nozzle though which the fluid passes, an upstream conduit connected to the nozzle at one end and valve means at the opposite end. The valve means has a valve gate and a valve seat dimensioned such that when the valve means is open, allowing the fluid to pass there beyond, flow rates on the both sides of the valve are substantially equal.

View from yet a further vantage point, it is an object of the present invention to provide a method of altering the present characteristics of the fluid stream which includes the steps of placing the fluid in a conduit under pressure, imparting turbulence to the fluid adjacent an outlet to the fluid, dispersing the fluid from the outlet such that the emerging flow exits as a linear ribbon, and allowing the fluid to converge on its own and form a substantially solid cylindrical shaft-like shape because of the forces imparted by the turbulence.

These and other objects will be made manifest in considering the following detailed specification when taken in conjunction with the appended drawing figures.

BRIEF DESCRIPTION OF THE DRAWING FIGURES

BRIEF DESCRIPTION OF THE PREFERRED EMBODIMENT

Figures 1, 2, 3, 4, 5:
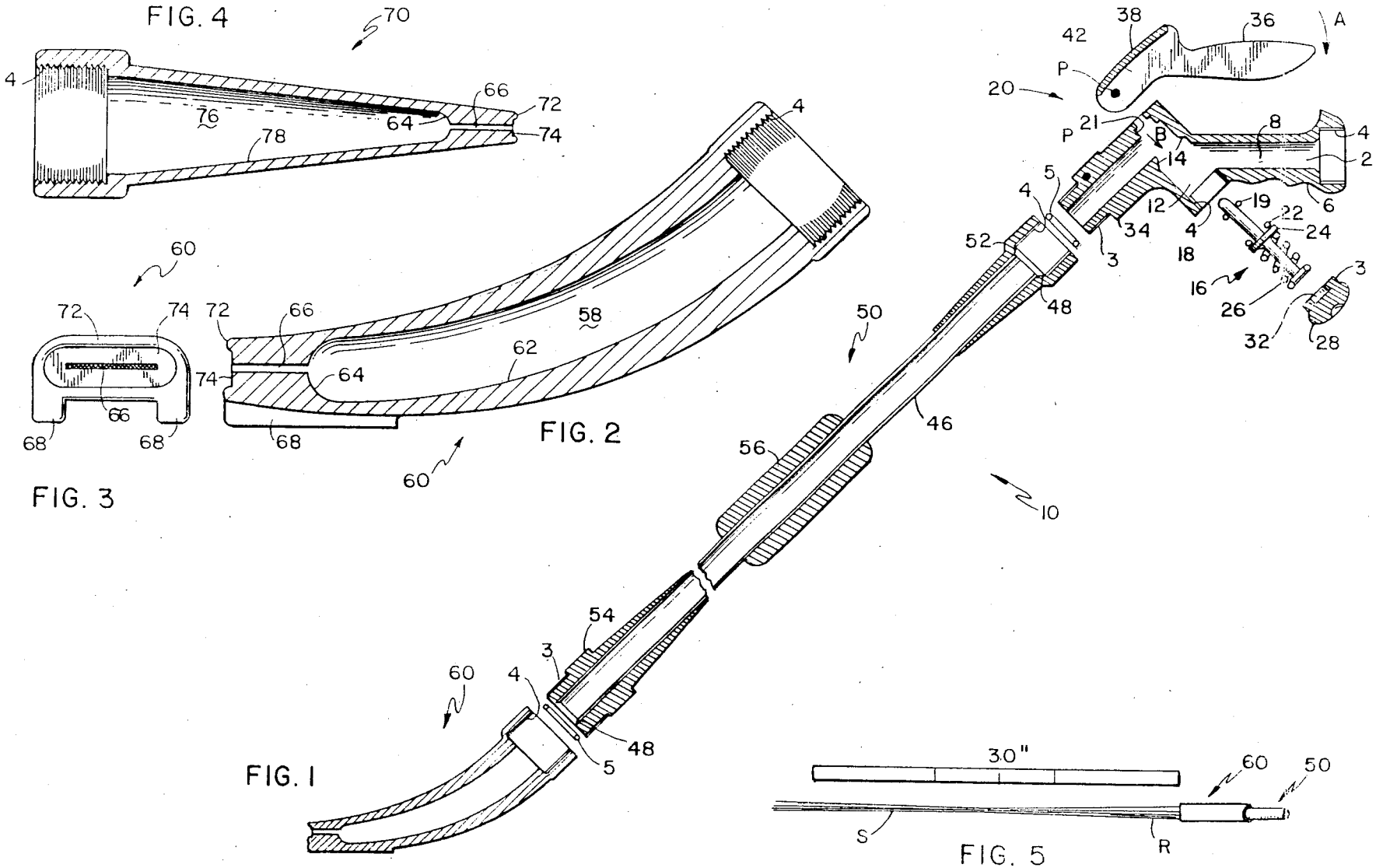
FIG. 1 is a side view, in section showing the apparatus according to the present invention in one form.
FIG. 2 is a detail of the nozzle shown in FIG. 1, also in section.
FIG. 3 is a front view showing the outlet pictured in FIG. 2.
FIG. 4 is a sectional view, similar to FIG. 2, but showing a second form of nozzle.
FIG. 5 depicts the fluid stream as it exits the nozzle, from a top plan view thereof.

Referring to the drawings now, wherein like reference numerals refer to like parts throughout the various drawing figures, reference numeral 10 is directed to the fluid wand according to the present invention.

In its essence, the fluid wand 10 is comprised of three elements: a pistol grip 20, a main body 50, and a nozzle two embodiments of which are shown in FIGS. 2 and 4 and respectively numbered 60 and 70. In its essence, water passes through inlet 2 of the pistol grip 20 once the valve within the pistol grip has been opened, and exits the nozzle providing a fluid geometry shown in FIG. 5.

More particularly, and with reference to FIG. 1, the pistol grip 20 is shown housing a valve body entirely therewithin. The pistol grip 20 includes a water inlet 2 which allows fluid to pass within a handle 6 via a cylindrical interior 8 of the handle. Typically, the inlet 2 will be coupled with a standard garden hose and thus have an internal thread 4 for fastening with the hose. The handle 6 has a lower most portion provided with a series of undulations that corresponds with the contour of one's fingers when grasping an article. This provides ergonomic efficiency. An opposed side of the handle 6 has a smooth cylindrical section which, together with the undulations, flares out rearwardly towards the water inlet 2.

The handle's cylindrical interior 8 communicates with a valve cavity 12 extending obliquely at an angle from the lineal cylindrical interior 8. Thereafter, the valve cavity communicates with a barrel passageway 44 at substantially right angles. The valve cavity intersects with the cylindrical interior at approximately a 45 degree angle. The valve cavity 12 supports a valve 16 which includes a valve stem 18, configured as an elongate rod. Substantially medially disposed along the length of the rod is a valve wall 24 carrying a valve seal 22 on one surface closest to the barrel passageway 44. This same side of the valve stem supports an 0-ring 19 adjacent to the free end of the stem for purposes to be described. A lower most portion of the valve stem, remote from the 0-ring 19 serves as a guide for a compression spring 26 having one end which resides within an end cap 28. The end cap has a recess 32 which serves as a seat for the spring and which receives a free end of the valve stem 18, remote from the O-ring 19. The cap 28 has an external thread 3 to fasten within an internal thread 4 communicating with the valve cavity 12.

The valve seal 22 will normally contact a valve seat 14 formed within the pistol grip valve body. When the valve stem reciprocates along the direction of the arrow B, the passageway beyond the valve seat will be selectively occluded. The degree of displacement of the valve seal 22 and its supporting valve wall 24 from the valve seat 14 provides a peripheral gap the cross sectional area of which equals the cross section of both the barrel passageway 44 and the handle's cylindrical interior 8. Thus, in the environment of incompressible fluid operating at pressure, such as water, there is no appreciable loss in pressure as a result of the valve's presence.

The end of the valve stem 18 carrying the O-ring 19 communicates with a second valve seat 21 fashioned in a barrel portion 34 of the pistol grip 20. Thus, reciprocation of the valve stem 18 along the direction of the arrow B is not of sufficient magnitude to have the O-ring 19 break its contact with the second valve slot 21 and thus provides a fluid-tight seal. The tip of the valve stem which extends beyond the barrel 34 contacts a horizontal shelf 38 of a trigger grip 36. The grip 36 includes the horizontal wall 38 and a pair of downwardly extending side walls 42 which straddle a top barrel portion of the pistol grip, and pivots about pivot point P. Note that the trigger grip 36 conforms to the outer contour of the pistol grip along the linear handle portion, opposite from the undulations. To activate the fluid wand, the trigger grip 36 is moved in the direction of the arrow A which forces the valve stem in the direction of the Arrow B, opening the valve. This action by one's hand is opposed by the compression spring 26 and, upon release of pressure, the valve will return to its normally closed position.

The fluid wand 10 also includes a main body 50. As shown in figure the main body 50 connects to the pistol grip 20 by means of an external thread 4 carried a free end of the barrel 34 and threadedly engages an internal thread 4 at an end of the main body 50 adjacent thereto. In addition, an O-ring gasket 5 provides e fluid-tight seal. The main body 50 includes an elongate tubular section 46 which has a flared mouth 4B at opposed extremities. The flared mouth is encapsulated by a pistol retainer 52 at one end and a nozzle retainer 54 at an opposed end. A medial portion of tube 46 supports a handgrip 56, preferably formed from a foam-type insulating material. This allows comfort when using the wand with either hot or cold fluid. Note that both the pistol retainer 52 and nozzle retainer 54 are preformed from molded plastic which encapsulates a portion of the flared mouth 48. The diameter of the tube 46 is selected to be the same as the cross sectional area of the barrel passageway 44. The nozzle retainer 54 has an exterior thread which couples with an internal thread 4 on the nozzle to be described. In addition, an O-ring gasket 5 is interposed at this juncture with the nozzle. The retainers 52 and 54 can in one form of the invention be freely rotatable on the tube 46. This facilitates assembly of the components forming the fluid wand.

With respect to FIGS. 2 and 3, one form of nozzle 60 is shown. This nozzle includes a inner-wall 62 defining a nozzle interior 58. The interior is of constant circular cross section along its entire length, until the transition with the hemispherical end wall 64. Because of the abrupt change in cross section at the hemispherical end wall 64, there is a substantial amount of turbulence which defines an important attribute of the instant invention. The turbulence, as mentioned above, alters the affinity of the individual droplets or molecules of water with respect to their cohesive affinity. This affinity is further enhanced when the only area of relief for the water is to pass through a rectangular box-shaped nozzle passageway 66. The passageway is sufficiently long to realign the individual droplets of water to exit as a sheet or ribbon of fluid leaving the nozzle at a relatively high velocity.

As shown in FIG. 3, the passageway 66 is circumscribed by a recessed wall 74 of substantially planar configuration which in turn is circumscribed by a substantially oval rim 72. The intersection of the recessed wall 74 with the box-shaped rectangular nozzle passageway 66 is constructed to provide a smooth area of transition minimizing any edge effects that could exist if the nozzle Were not so configured. The peripheral rim 72 has the effect of preserving the configuration of the recessed wall 74 with respect to the passageway 66 thereby rendering it less likely that this geometry will be altered during use, for example, by contacting surfaces. Thus, the rim serves a protective function. In addition, a pair of downwardly extending feet 68 communicate from side and edge walls of the nozzle to provide a stable source of support when resting the nozzle on the ground. It is contemplated that the entire nozzle structure be made of a cast plastic material formed in a mold in one section similar to that which is shown in FIG. 2 and using a core pin to maintain the contour of both the passageway 66 and interior 58. The mold should be of sufficiently high tolerance that no flashing exists on the mold so that there are no rough edges along the area of transition throughout the interior 58 leading through the passageway 66.

FIG. 4 reflects a second version of the nozzle. There, it is shown that the internal thread 4 allows communication with a conically tapering interior passageway 66 having progressively decreasing circular cross section as it extends to the passageway 66. As before, the area immediately adjacent to the passageway 66 includes a hemispherical end wall 64 for similar purposes. Note also the presence of the peripheral lip 72 and recessed wall 74.

In use and operation, once the device has been assembled as described above, and perhaps with the inclusion of a filter screen (not shown) nearest water inlet 2, the fluid wand 10 when connected to a suitable source of fluid under pressure will emit a stream of water which for the first 30 inches (depending upon water pressure) will exhibit a substantially lineal ribbon of water (FIG. 5). Thereafter, the ribbon reforms on its own to form a solid shaft of water which extends an appreciable distance without divergence of plural droplets forming the stream, providing a more focused, concentrated coherent stream of water.

Having thus described the invention it should be apparent that numerous structural modifications and adaptations may be resorted to without departing from the scope and fair meaning of the instant invention as detailed hereinabove and as claimed hereinbelow.

I claim:

1. A fluid dispensing device comprising, in combination: a nozzle through which the fluid passes, an upstream conduit connected to said nozzle at one end and valve means at an opposite end, said valve means having a valve gate and a valve seat dimensioned such that, when said valve means is open, allowing the fluid to pass therebeyond, flow rate on both sides of said valve means is substantially equal, wherein said valve means includes a handle portion, a valve cavity and associated valve housing portion, and a barrel portion, passageways in said barrel and an interior of said handle of substantially identical circular cross-section, said handle including a trigger grip carried on a top surface and undulations on a bottom surface to facilitate manually grasping said handle, said trigger grip including a top wall overlying a portion of said barrel and downwardly extending side walls, said trigger grip pivoted to said barrel portion and said trigger grip's cylindrical interior communicating with an opening in said valve housing portion, wherein said valve housing portion and said opening receives a free end of a valve stem to pass therethrough and underlie said trigger top wall, an O-ring circumscribing a portion of said stem and adjacent said top wall and in fluid-tight communication with an O-ring seat thereat, a valve wall medially disposed on said valve stem supporting a valve seal on a surface proximate to said O-ring, said valve seal juxtaposed to an integrally formed valve seat carried in said valve housing portion, whereby reciprocation of said valve stem by said trigger grip moves said valve seal and associated valve wall away from said valve seat from a closed to an open position, wherein said valve stem further includes a portion extending from said valve wall remote from said valve seal, said last named stem portion supporting a compression spring thereover and a free end of said compression spring residing within a recess carried on an end cap threadedly connected to a portion of said valve housing, whereby releasing said trigger grip automatically closes said valve, wherein said nozzle received fluid from said pistol grip and has an interior of circular cross section, and an end wall adjacent a nozzle slit is configured as a hemispherically shaped wall, wherein said nozzle slit is a rectangular box-like passageway, wherein said nozzle interior decreases in circular cross section as it approaches said hemispherical wall.

2. A method of altering the characteristics of a fluid stream comprising the steps of: placing the fluid in a conduit under pressure, imparting turbulence to the fluid adjacent an outlet for the fluid, dispersing the fluid from the outlet by forcing the fluid to exit as a linear ribbon, thereafter causing the fluid to converge and form a substantially solid cylindrical shaft-like shape because of the forces imparted by both the turbulence and forcible fluid exiting from the outlet, including the step of imparting turbulence to the fluid by contacting the fluid with a hemispherical end wall immediately adjacent the outlet.

3. The method of claim 2 including the step of dispersing the fluid from the outlet by forming the outlet as a substantially rectangular box-like passageway so that the fluid exits as a linear ribbon devoid of forces which would tend to distort the fluid stream.

4. A fluid dispensing device comprising, in combination: a nozzle through which the fluid passes, an upstream conduit, said conduit connected to said nozzle at one end and valve means at an opposite end, said valve means having a valve gate and a valve seat dimensioned such that, when said valve means is open, allowing the fluid pass therebeyond, flow rate on both sides of said valve means is substantially equal, said valve means including an upstream handle portion having an interior which is hollow and includes a cross section which equals said upstream hollow conduit's cross section, wherein said valve means includes a handle portion, a valve portion, a valve cavity and associated valve housing portion, and a barrel portion, passageways in said barrel and an interior of said handle of substantially identical circular cross section, said handle including a trigger grip carried on a top surface and undulations on a bottom surface to facilitate manually grasping said handle, said trigger grip including a top wall overlying a portion of said barrel and downwardly extending side walls, said trigger grip pivoted to said barrel portion and said trigger grips cylindrical interior communicating with an opening in said valve housing portion, wherein said valve housing portion and said opening receives a free end of a valve stem to pass therethrough and underlie said trigger top wall, an O-ring circumscribing a portion of said stem adjacent said top wall and in fluid-tight communication with a valve seat thereat, a valve wall medially disposed on said valve stem supporting a valve seat on a surface proximate to said O-ring, said valve seal selectively coupled to an integrally formed valve seat carried in said valve housing portion, whereby reciprocation of said valve stem by said trigger grip moves said valve seal from a closed to an open position.

5. The device of claim 4 wherein said valve stem further includes a portion extending from said valve wall remote from said valve seal, said last named stem portion supporting a compression spring there over and a free end of said compression spring residing within a recess carried on an end cap threadedly connected to a portion of said valve housing, whereby releasing said trigger grip automatically closes said valve.

6. The device of claim 5 wherein said nozzle receives fluid from said pistol grip and has an interior of circular cross section, and an end wall adjacent a nozzle slit is configured as a hemispherically shaped wall.

7. The device of claim 6 wherein said nozzle slit is a rectangular box-like passageway.

8. The device of claim 7 wherein said nozzle interior decreases in circular cross section as it approaches said hemispherical wall.

* * * * *